United States Patent [19]

Paley

[11] 4,333,132

[45] Jun. 1, 1982

[54] SWIVEL UNIT FOR ADJUSTABLE LIGHTING FIXTURE

[75] Inventor: Gary Paley, Cornwall-On-Hudson, N.Y.

[73] Assignee: Square D Company, Palatine, Ill.

[21] Appl. No.: 37,623

[22] Filed: May 10, 1979

[51] Int. Cl.[3] ..... F21M 3/18

[52] U.S. Cl. ..... 362/421; 362/389; 362/427; 362/432; 403/144

[58] Field of Search ..... 403/144; 362/421, 389, 362/427, 432

[56] References Cited

U.S. PATENT DOCUMENTS 3,278,203 10/1966 Snyder ..... 362/421

*Primary Examiner*—Stephen J. Lechert, Jr.
*Attorney, Agent, or Firm*—Carmen B. Patti; John R. Garrett

[57] ABSTRACT

This disclosure depicts a novel environmentally sealed and manually controlled swivel unit for use in an adjustable lighting fixture. The swivel unit comprises a base, a housing, a swivel ball device and a swivel ball controller. The swivel unit further comprises a tension means for forcing the swivel ball controller against the swivel ball device, and, in turn, for forcing the swivel ball device against a shoulder of the housing. This defines a predetermined lamp-holding force. The swivel ball controller allows the swivel ball device to rotate about a first axis and also to rotate about a second axis perpendicular to the first axis. The swivel ball device and the shoulder on the housing form an environmentally sealed juncture. The predetermined lamp-holding force retains the swivel ball device at any selected position while allowing easy manual movement of the swivel ball device. By a combination of rotations about the first and second axes, the apparatus can direct light to any objective oriented hemispherically with regard to the two axes while maintaining environmental integrity.

15 Claims, 5 Drawing Figures

SWIVEL UNIT FOR ADJUSTABLE LIGHTING FIXTURE

BACKGROUND OF THE INVENTION AND PRIORITY STATEMENTS

This invention relates in general to swivel units for lighting fixtures and, in particular, to a swivel unit which is environmentally sealed and easily adjusted without the use of any tools.

Conventionally, swivel units have been utilized for lighting fixtures with the construction of the swivel unit being such that the lighting fixture is pivotable about one axis through substantially 90°, and pivotable about a second axis at right angles to the first axis through substantially 360°. This combination of pivotable movements enables the fixture to direct light over selected portions of extensive area.

In the use of swivel units, the tendency has been to increase the mechanical load thereon because of the larger size lamps and the larger size shades required for these lamps. However, it has been found that larger loads exert large mechanical forces which act to displace the swivel unit from the position to which it was adjusted.

In order to keep the lighting fixture in its selected position, typical devices such as thumb screws, special clamps and normal screws have been used. Alternatively, springs under compression have also been used. However, in order to retain the lighting fixture in its selected position, devices using compressed springs must place these springs under a great deal of force. Devices utilizing a compressed spring are difficult to assemble and have a large number of parts. U.S. Pat. No. 3,072,426 issued to Gilbert and U.S. Pat. No. 3,409,315 issued to Wichers et al. illustrate this type of device. Another patent illustrating this type of device in U.S. Pat. No. 3,341,230 issued to Wichers.

Another type of adjustable lighting fixture known utilizes a sphere clamped between two plates, thereby causing the sphere to be under tension and allowing the sphere to rotate between the plates. A drawback with this device and many others of similar construction is that the wiring in the device is not sealed to the outside atmosphere, and therefore, if this device is used outside, moisture or rain may contact the wiring and cause a short. The swivel unit disclosed in U.S. Pat. No. 3,072,426 appears to have no exposed wires; however, to achieve this it incorporates a large number of parts thereby having the drawback of expensive assembly.

The present invention has general applicability but is most advantageously applied to a swivel unit for a lighting fixture.

The relevance of the prior art indicated in the present specification should not be given a limited interpretation. A cited prior art item may be found to have relevance in a passage other than the one referred to, or to have relevance in a sense different than as stated.

OBJECTS OF THE INVENTION

It is a general object of the present invention to provide for a lighting fixture an improved swivel unit.

It is a more specific object of the present invention to provide a swivel unit which remains at any selected position, while allowing easy manual movement of the swivel unit.

It is a further object to provide a swivel unit which is capable of rotating substantially 360° about a first axis and rotating and distributing light 180° about a second axis perpendicular to the first axis.

It is yet another object to provide a swivel unit which is environmentally sealed and has no exposed wiring regardless of the position or orientation of the lamp.

It is still another object of the present invention to provide a swivel unit which is effective, yet low in cost, and provides an ease of assembly.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

FIG. 2A illustrates the effective 180° range of motion of the lamp about an axis passing longitudinally through the base and lamp assembly while FIG. 2B is an end-on view illustrating the range of rotation of the lamp about a transverse axis which is perpendicular to the longitudinal axis.

DESCRIPTION OF THE PREFERRED EMBODIMENT

Figures 1, 3, 4:
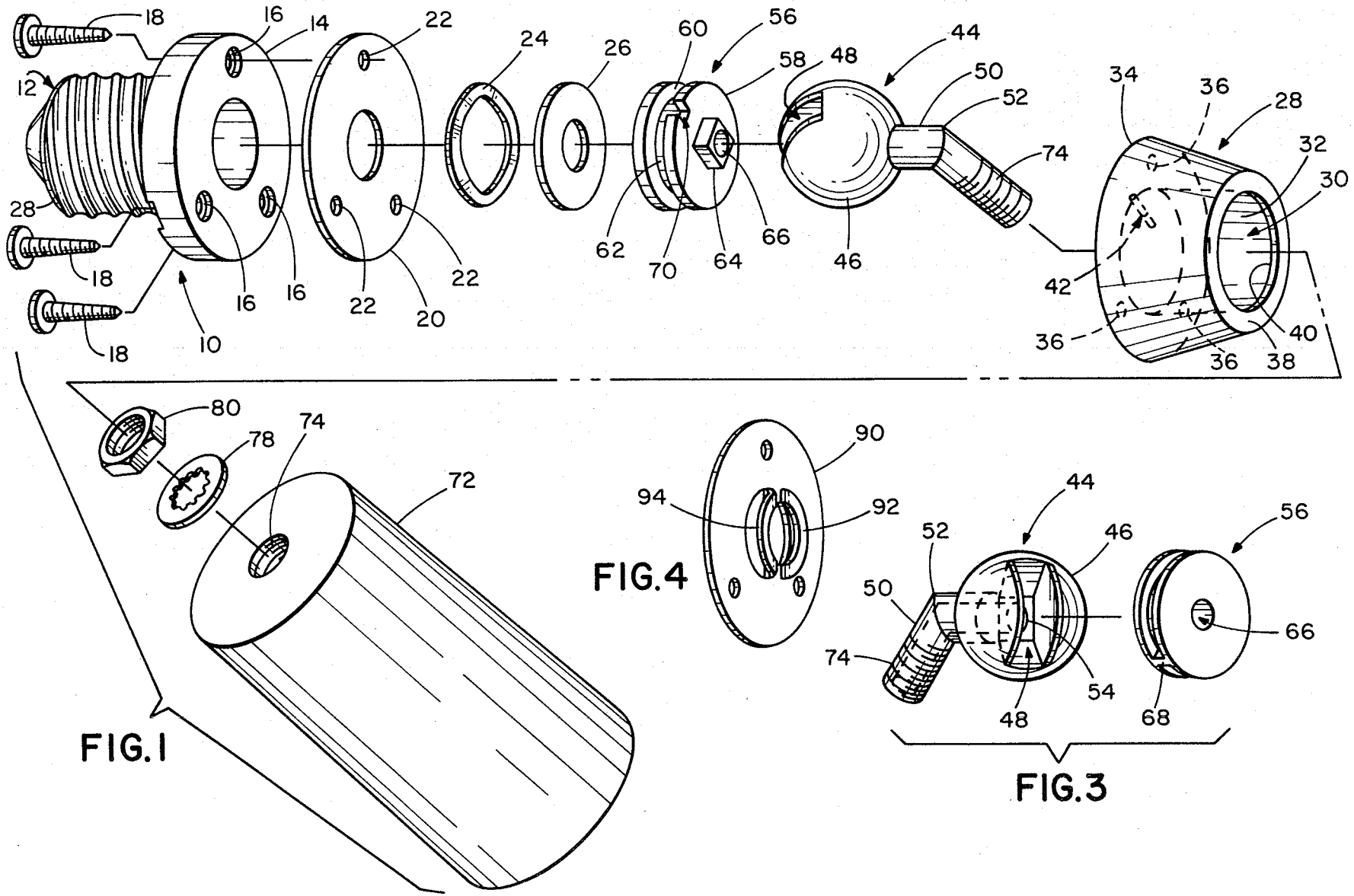
FIG. 1 is an exploded perspective view of the novel swivel unit utilized in a lighting fixture.
FIG.3 is a perspective view of two parts of the FIG. 1 swivel unit.
FIG. 4 is a perspective view of an alternative embodiment of a part of the FIG. 1 swivel unit.

Whereas the invention may be implemented in various types of lighting fixtures and other devices, it is preferably embodied in a lighting fixture as illustrated in FIG. 1. This invention relates to a novel swivel unit for use in the lighting fixture.

In general terms, this invention involves a novel environmentally sealed and manually controlled swivel unit. The swivel unit comprises in part a base for establishing electrical and mechanical connection with a source of electrical power. The swivel unit also has a housing having a central housing bore defining an inner surface. The housing has a first end for attachment to the base and a second end having an internal shoulder. The housing also has a guide pin extending radially inwardly a predetermined distance from the inner surface and near the first end of the housing. The swivel unit further comprises a swivel ball device having a spherical body with a predetermined rectangular cavity and a tube extending from the spherical body opposite the cavity. The tube has a predetermined bend and the spherical body has a tunnel connecting the tube to the cavity. The spherical body also has a predetermined diameter substantially equal to the diameter of the central bore in the housing. The swivel ball is contained inside of the housing adjacent the shoulder on the second end of the housing. The swivel unit also comprises a swivel ball controller having first and second circular rims spaced apart a predetermined distance and connected by a circular body member. The controller also has a square cavity guide extension centrally located on the first rim opposite the body member. The first and second rim, the body member and the cavity guide extension have a central controller bore. The swivel ball controller also has a stop wall extending between the first and second rims and also extending from the edge of the rim to the circular body member. The first and second rims have a diameter substantially equal to the diameter of the central housing bore in the housing and the circular body member has a diameter less than the diameter of the rims. The swivel ball controller is located in the central housing bore near the first end such that the cavity guide extension rides in the cavity in the swivel ball device, and the guide pin in the housing rides between the first and second rims. The swivel unit further comprises a tension means for forcing the swivel ball controller against the swivel ball device, and, in turn, for forcing the swivel ball device against the shoulder of the housing. This defines a predetermined lamp-holding force. The tension means is located between the swivel ball controller and the base when the base is attached to the first end of the housing. The swivel ball controller allows the swivel ball device to rotate about a first axis and also to rotate about a second axis perpendicular to the first axis. The swivel ball device and the shoulder on the housing form an environmentally sealed juncture. The predetermined lamp-holding force retains the swivel ball device at any selected position while allowing easy manual movement of the swivel ball device.

FIG. 1 shows an exploded perspective view of the present invention utilized in a preferred embodiment. In this embodiment a base 10 is used which is structured so that it may be screwed into a standard lightbulb-type socket. The base 10 has a threaded body 12 attached to a flange 14. The end of the threaded body 12 opposite the flange 14 is structured similarly to the standard lightbulb structure such that it will establish electrical connection with a standard socket. The flange 14 has apertures 16 through which the threaded portion of screws 18 may pass. A metal retaining plate 20 with apertures 22 is located next to the flange 14. A tension means, a wave washer 24, is sandwiched between the retaining plate 20 and a regular washer 26. Although the regular washer 26 is not necessary, it does allow for ease of operation. Also, the retaining plate 20 could be molded into the flange 14 of the base 10 if desired. FIG. 4 shows an alternative embodiment for the plate 20 and wave washer 24. A tension plate 90 has two raised spring-like portions 92 and 94 which contact washer 26. The tension plate 90 is located next to flange 14 of the base 10 when the swivel unit is assembled. Next will be described the actual swivel mechanism.

A housing having the shape of a truncated core 28 has a central housing bore 30 defining an inner surface 32. The housing 28 has a first end 34 with threaded holes 36 for attachment to the base 10. When assembled, the apertures 16 in the flange 14 and the apertures 22 in the retaining plate 20 are in alignment with the threaded holes 36 such that the screws 18 may pass through the apertures 16 and 20 and be threaded into the holes 36, thereby securing the base 10 to the housing 28. The housing 28 also has a second end 38 which has an internal shoulder 40. A guide pin 42 extends radially inwardly a predetermined distance from the inner surface 32 near the first end 34 of the housing 28.

A swivel ball device 44 has a spherical body 46 with a predetermined rectangular cavity 48 and a tube 50 extending from the spherical body 46 radially opposite the cavity 48. The tube 50 has a bend 52 of approximately 45° and the spherical body 46 has a tunnel 54 connecting the tube 50 to the cavity 48. The spherical body 46 has a predetermined diameter substantially equal to the diameter of the central bore 30 in the housing 28. When assembled, the swivel ball device 44 is contained inside of the housing 28 adjacent the shoulder 40 on the second end 38 of the housing 28.

A swivel ball controller 56 has first and second circular rims 58 and 60 spaced apart a predetermined distance and connected by a circular body member 62. A square cavity guide extension 64 is centrally located on the first rim 58 opposite the body member 62. The first and second rims 58 and 60, the body member 62 and the cavity guide extension 64 have a central controller bore 66. The swivel ball controller 56 also has a stop wall 68 extending between the first and second rims 58 and 60 and also extending from the edge of the rims 58 and 60 to the circular body member 62. The first and second rims 58 and 60 have a diameter substantially equal to the diameter of the central housing bore 30 in the housing 28, and the circular body member 62 has a diameter less than the diameter of the rims 58 and 60. When assembled, the swivel ball control 56 is located in the central housing bore 30 near the first end 34 of the housing 28, such that the cavity guide extension 64 rides in the cavity 48 in the swivel ball device 44 and the guide pin 42 in the housing 28 rides between the first and second rims 58 and 60 of the swivel ball controller 56. The swivel ball controller 56 also has a slot 70 located in the first rim 58 and is sufficient in size to allow passage of the guide pin 42 in the housing 28 during assembly. The stop wall prevents rotations of more than 360°, thereby preventing damage to wires inside the device.

A standard lamp-holder 72 is secured to the end of the tube 50. In the preferred embodiment the end of the tube 50 is threaded so that a threaded hole in the lamp-holder 72 may be utilized to secure the lamp-holder 72 to the tube 50. A standard washer 78 and nut 80 lock the lamp-holder 72 onto the tube 50.

When assembled, the swivel ball device 44 and the shoulder 40 of the housing 28 comprise a sealing means and thus form an environmentally sealed juncture thereby protecting the internal wiring of the swivel unit. The environmental sealing results from the orientation and encapsulation of all of the elements within the housing 28. Also in the assembled unit, the wave washer 24 is a tension means for forcing the swivel ball controller 56 against the swivel ball device 44 and, in turn, for forcing the swivel ball device 44 against the shoulder 40 of the housing 28, thereby defining a predetermined lamp-holding force. The predetermined lamp-holding force retains the swivel ball device 44 at any selected position while allowing easy manual movement.

The central controller bore 30, the cavity 48 and tunnel 54 in the spherical body 46 and the tube 50 of the swivel ball device 44 define a continuous passageway for electrical wires for electrically connecting electrical contacts on the base 10 to electrical contacts in the lamp-holder 72.

Figure 2A:
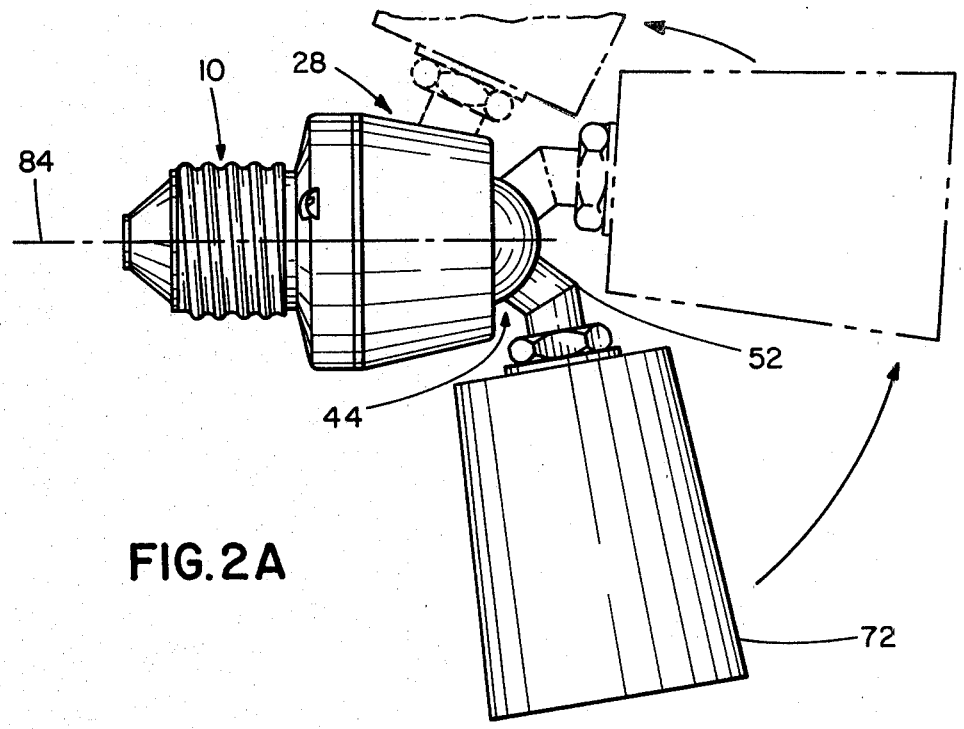
FIGS. 2A and 2B show the assembled lighting fixture and illustrate the movement of the swivel unit.
Figure 2B:
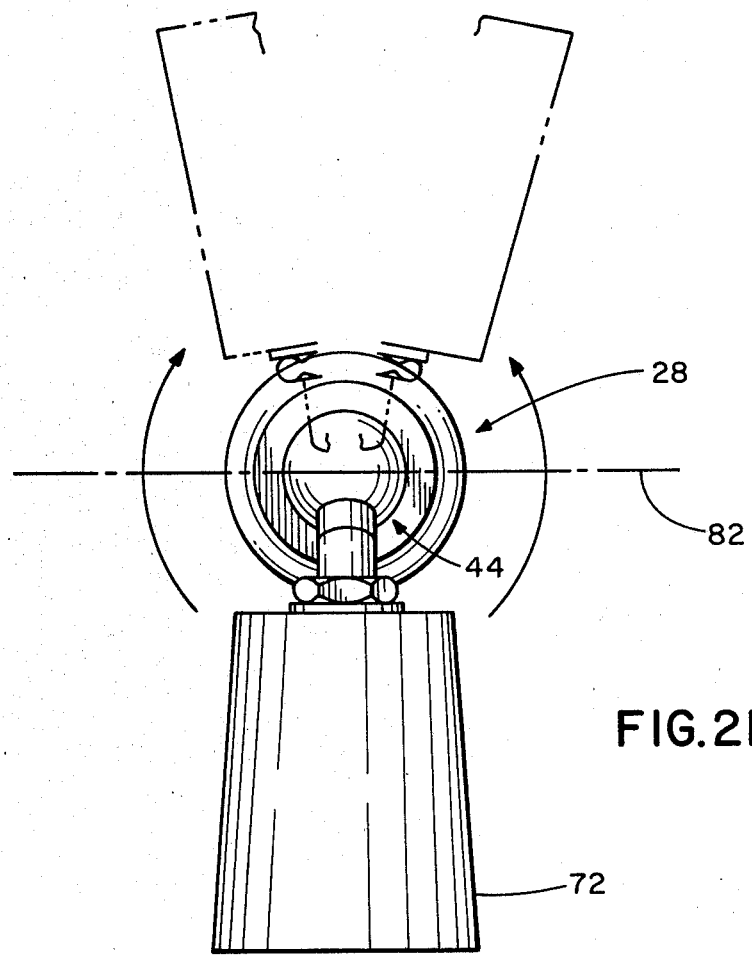

FIGS. 2A and 2B illustrate the range of rotation possible by the lamp-holder 72 and swivel ball device 44 while maintaining an environmentally sealed juncture of the swivel ball device 44 and the internal shoulder 40 of the housing 28. Because of the 45° bend 52 in the tube 50, the lamp-holder 72, in relation to the base 10 and housing 28, can achieve a rotation of 90° about a second axis 82. The first axis 84 is perpendicular to the second axis 82. The lamp holder 72 and swivel ball device 44 can rotate about the first axis 84 a full 360°. Most importantly, any combination of a rotation within the 360° about the first axis 84 and within the 90° about the second axis 82 results in the orientation of the lamp 72 and the direction of light toward any objective within a hemispherical orientation to axes 84 and 82 while maintaining an environmentally sealed position such that the wiring is not exposed to moisture or any other weather condition.

The invention is not limited to the particular details of construction of the device depicted and other modifications and applications are contemplated. For example, the wave washer 24 may be replaced by a spring. Also, the base may have other configurations such as a plug-in-style for use with an electrical wall plug, a structure for direct attachment to an electrical outlet box, or structures for specialty applications. The invention may be used in a device having two or more swivel units and lamps. Certain other changes may be made in the above described apparatus without departing from the true spirit and scope of the invention herein involved. It is intended, therefore, that the subject matter in the above depiction shall be interpreted as illustrative and not a limiting sense.

What is claimed is:

1. An environmentally sealed and manually controlled swivel unit comprising:

a base for establishing electrical and mechanical connection with a source of electrical power;

a housing having a central housing bore defining an inner surface, said housing having a first end for attachment to said base and a second end having an internal shoulder, said housing also having a guide pin extending radially inward a predetermined distance from said inner surface near said first end;

a swivel ball device having a spherical body with a predetermined rectangular cavity and a tube extending from said spherical body opposite said cavity, said tube having a predetermined bend and said spherical body having a tunnel connecting said tube to said cavity, said spherical body also having a predetermined diameter substantially equal to the diameter of said central bore in said housing, said swivel ball being contained inside of said housing adjacent said shoulder on said second end of said housing;

a swivel ball controller having first and second circular rims spaced apart a predetermined distance and connected by a circular body member, said controller also having a square cavity guide extension centrally located on said first rim opposite said body member, said first and second rims, said body member and said cavity guide extension having a central controller bore, said swivel ball controller also having a stop wall extending between said first and second rims and also extending from the edge of said rims to said circular body member, said first and second rims having a diameter substantially equal to said diameter of said central housing bore in said housing and said circular body member having a diameter less than the diameter of said rims, said swivel ball controller being located in said central housing bore near said first end such that said cavity guide extension rides in said cavity in said swivel ball device and said guide pin in said housing rides between said first and second rims, a tension means for forcing said swivel ball controller against said swivel ball device and for forcing said swivel ball device against said shoulder of said housing thereby defining a predetermined lamp-holding force, said tension means being located between said swivel ball controller and said base when said base is attached to said first end of said housing, wherein said swivel ball controller allows said swivel ball device to rotate about a first axis and to rotate about a second axis perpendicular to said first axis, and also wherein said swivel ball device and said shoulder on said housing form an environmentally sealed juncture, and further wherein said predetermined lamp holding force retains said swivel ball device at any selected position while allowing easy manual movement of said swivel ball device.

2. The apparatus defined in claim 1 wherein said predetermined bend in said tube of said swivel ball device is approximately 45°.

3. The apparatus defined in claim 1 wherein said swivel ball device is able to rotate substantially 360° about said first axis and 90° about said second axis.

4. The apparatus defined in claim 1 wherein said tension means is a wave washer.

5. The apparatus defined in claim 1 wherein said tension means is a tension plate having a pair of raised spring-like portions, said raised spring-like portions contacting said swivel ball controller.

6. The apparatus defined in claim 1 wherein said swivel ball controller has a slot located in said first rim sufficient in size to allow passage of said guide pin in said housing during assembly.

7. The apparatus defined in claim 1 wherein a lampholder is attached to the end of said tube of said swivel ball device.

8. The apparatus defined in claim 6 wherein said central controller bore, and said cavity and tunnel in said spherical body and said tube of said swivel ball device define a continuous passageway for electrical wires for electrically connecting said base to said lampholder.

9. An environmentally sealed and manually controlled swivel unit comprising:

a base for establishing electrical and mechanical connection with a source of electrical power;

a housing having a central housing bore defining an inner surface, said housing having a first end for attachment to said base and a second end having an internal shoulder, said housing also having a guide pin extending radially inward a predetermined distance from said inner surface near said first end;

a swivel ball device having a spherical body with a predetermined rectangular cavity and a tube extending from said spherical body opposite said cavity, said tube having a substantially 45° bend and said spherical body having a tunnel connecting said tube to said cavity, said spherical body also having a predetermined diameter substantially equal to the diameter of said central bore in said housing, said swivel ball being contained inside of said housing adjacent said shoulder on said second end of said housing;

a swivel ball controller having first and second circular rims spaced apart a predetermined distance and connected by a circular body member, said controller also having a square cavity guide extension centrally located on said first rim opposite said body member, said first and second rims, said body member and said cavity guide extension having a central controller bore, said swivel ball controller also having a stop wall extending between said first and second rims and also extending from the edge of said rims to said circular body member, said first and second rims having a diameter substantially equal to said diameter of said central housing bore in said housing and said circular body member having a diameter less than the diameter of said rims, said swivel ball controller being located in said central housing bore near said first end such that said cavity guide extension rides in said cavity in said swivel ball device and said guide pin in said housing rides between said first and second rims, said swivel ball controller also having a slot located in said first rim sufficient in size to allow passage of said guide pin in said housing during assembly;

a wave washer located between said swivel ball controller and said base when said base is attached to said first end of said housing for forcing said swivel ball controller against said swivel ball device and for forcing said swivel ball device against said shoulder of said housing, thereby defining a predetermined lamp holding force;

a lamp holder attached to the end of said tube of said swivel ball device;

wherein said swivel ball controller allows said swivel ball device to rotate substantially 360° about a first axis and to rotate substantially 90° about a second axis perpendicular to said first axis, and wherein said central controller bore, said cavity and tunnel in said spherical body and said tube of said swivel ball device define a continuous passageway for electrical wires for electrically connecting electrical contacts on said base to electrical contacts in said lamp-holder, and also wherein said swivel ball device and said shoulder on said housing form an environmentally sealed juncture, and further wherein said predetermined lamp-holding force retains said swivel ball device at any selected position while allowing easy manual movement of said swivel ball device.

10. An environmentally sealed and manually controlled swivel unit comprising:

a base for establishing electrical and mechanical connection with a source of electrical power;

a housing havng a central housing bore defining an inner surface, said housing having a first end for attachment to said base and a second end having an internal shoulder, said housing also having a guide pin extending radially inward a predetermined distance from said inner surface near said first end;

a swivel ball device having a spherical body with a predetermined rectangular cavity and a tube extending from said spherical body opposite said cavity, said tube having a substantially 45° bend and said spherical body having a tunnel connecting said tube to said cavity, said spherical body also having a predetermined diameter substantially equal to the diameter of said central bore in said housing, said swivel ball being contained inside of said housing adjacent said shoulder on said second end of said housing;

a swivel ball controller having first and second circular rims spaced apart a predetermined distance and connected by a circular body member, said controller also having a square cavity guide extension centrally located on said first rim opposite said body member, said first and second rims, said body member and said cavity guide extension having a central controller bore, said swivel ball controller also having a stop wall extending between said first and second rims and also extending from the edge of said rims to said circular body member, said first and second rims having a diameter substantially equal to said diameter of said central housing bore in said housing and said circular body member having a diameter less than the diameter of said rims, said swivel ball controller being located in said central housing bore near said first end such that said cavity guide extension rides in said cavity in said swivel ball device and said guide pin in said housing rides between said first and second rims, said swivel ball controller also having a slot located in said first rim sufficient in size to allow passage of said guide pin in said housing during assembly;

a tension plate having a pair of raised spring-like portions located between said swivel ball controller and said base when said base is attached to said first end of said housing for forcing said swivel ball controller against said swivel ball device and for forcing said swivel ball device against said shoulder of said housing, thereby defining a predetermined lamp holding force, said pair of raised spring-like portions contacting said swivel ball controller;

a lamp holder attached to the end of said tube of said swivel ball device;

wherein said swivel ball controller allows said swivel ball device to rotate substantially 360° about a first axis and to rotate substantially 90° about a second axis perpendicular to said first axis, and wherein said central controller bore, said cavity and tunnel in said spherical body and said tube of said swivel ball device define a continuous passageway for electrical wires for electrically connecting electrical contacts on said base to electrical contacts in said lamp-holder, and also wherein said swivel ball device and said shoulder on said housing form an environmentally sealed juncture, and further wherein said predetermined lamp-holding force retains said swivel ball device at any selected position while allowing easy manual movement of said swivel ball device.

11. An environmentally sealed and manually controlled swivel unit comprising:

a base;

a housing having a central housing bore defining an inner surface, said housing having a first end for attachment to said base and a second end having an internal shoulder, said housing also havng a guide pin extending radially inward a predetermined distance from said inner surface near said first end;

a swivel ball device having a spherical body with a predetermined rectangular cavity and a member extending from said spherical body opposite said cavity, said spherical body also having a predetermined diameter substantially equal to the diameter of said central bore in said housing, said swivel ball being contained inside of said housing adjacent said shoulder on said second end of said housing;

a swivel ball controller having first and second circular rims spaced apart a predetermined distance and connected by a circular body member, said controller also having a square cavity guide extension centrally located on said first rim opposite said body member, said swivel ball controller also having a stop wall extending between said first and second rims and also extending from the edge of said rims to said circular body member, said first and second rims having a diameter substantially equal to said diameter of said central housing bore in said housing and said circular body member having a diameter less than the diameter of said rims, said swivel ball controller being located in said central housing bore near said first end such that said cavity guide extension rides in said cavity in said swivel ball device and said guide pin in said housing rides between said first and second rims, a tension means for forcing said swivel ball controller against said swivel ball device and for forcing said swivel ball device against said shoulder of said housing thereby defining a predetermined holding force, said tension means being located between said swivel ball controller and said base when said base is attached to said first end of said housing, wherein said swivel ball controller allows said swivel ball device to rotate about a first axis and to rotate about a second axis perpendicular to said first axis, and also wherein said swivel ball device and said shoulder on said housing form an environmentally sealed juncture, and further wherein said predetermined holding force retains said swivel ball device at any selected position while allowing easy manual movement of said swivel ball device.

12. The apparatus defined in claim 11 wherein said member predetermined bend of approximately 45°.

13. The apparatus defined in claim 11 wherein said swivel ball device is able to rotate substantially 360° about said first axis and 90° about said second axis.

14. The apparatus defined in claim 11 wherein said tension means is a wave washer.

15. The apparatus defined in claim 11 wherein said tension means is a tension plate having a pair of raised spring-like portions, said raised spring-like portions contacting said swivel ball controller.

* * * * *